United States Patent [19]

Todeschini

[11] 3,987,428

[45] Oct. 19, 1976

[54] OPTICAL LASER SECURITY SYSTEM

[75] Inventor: David John Todeschini, Brooklyn, N.Y.

[73] Assignee: The Raymond Lee Organization, Inc., New York, N.Y. ; a part interest

[22] Filed: June 16, 1975

[21] Appl. No.: 587,308

[52] U.S. Cl. ..... 340/258 D; 250/199; 250/578; 340/276

[51] Int. Cl.[2] ..... G08B 13/18

[58] Field of Search ..... 340/258 B, 258 D, 280, 340/276; 250/578, 221, 199; 332/9 R, 9 T

[56] References Cited

UNITED STATES PATENTS

| | | | |
|---|---|---|---|
| 3,120,654 | 2/1964 | Lee | 340/258 B |
| 3,153,196 | 10/1964 | McGuire | 332/9 R |
| 3,623,057 | 11/1971 | Hedin et al. | 340/258 B |
| 3,719,938 | 3/1973 | Perlman | 340/258 B |
| 3,727,207 | 4/1973 | Missio et al. | 340/258 B |
| 3,898,639 | 8/1975 | Muncheryan | 340/258 B |

*Primary Examiner*—Glen R. Swann, III
*Attorney, Agent, or Firm*—Howard I. Podell

[57] ABSTRACT

An optical laser is operated in a continuous mode and modulated by a random noise generator. The laser beam is split into parallel beams which are reflected throughout the area by mirrors and each directed into a photo sensitive electronic receptor circuit which electronically combines the output signals of the parallel beams of laser light. The combined output is electronically compared with the signal employed to modulate the laser beams, with an alarm circuit triggered when any difference is detected between the output signal generated by the laser beams and the input modulating signal.

2 Claims, 1 Drawing Figure

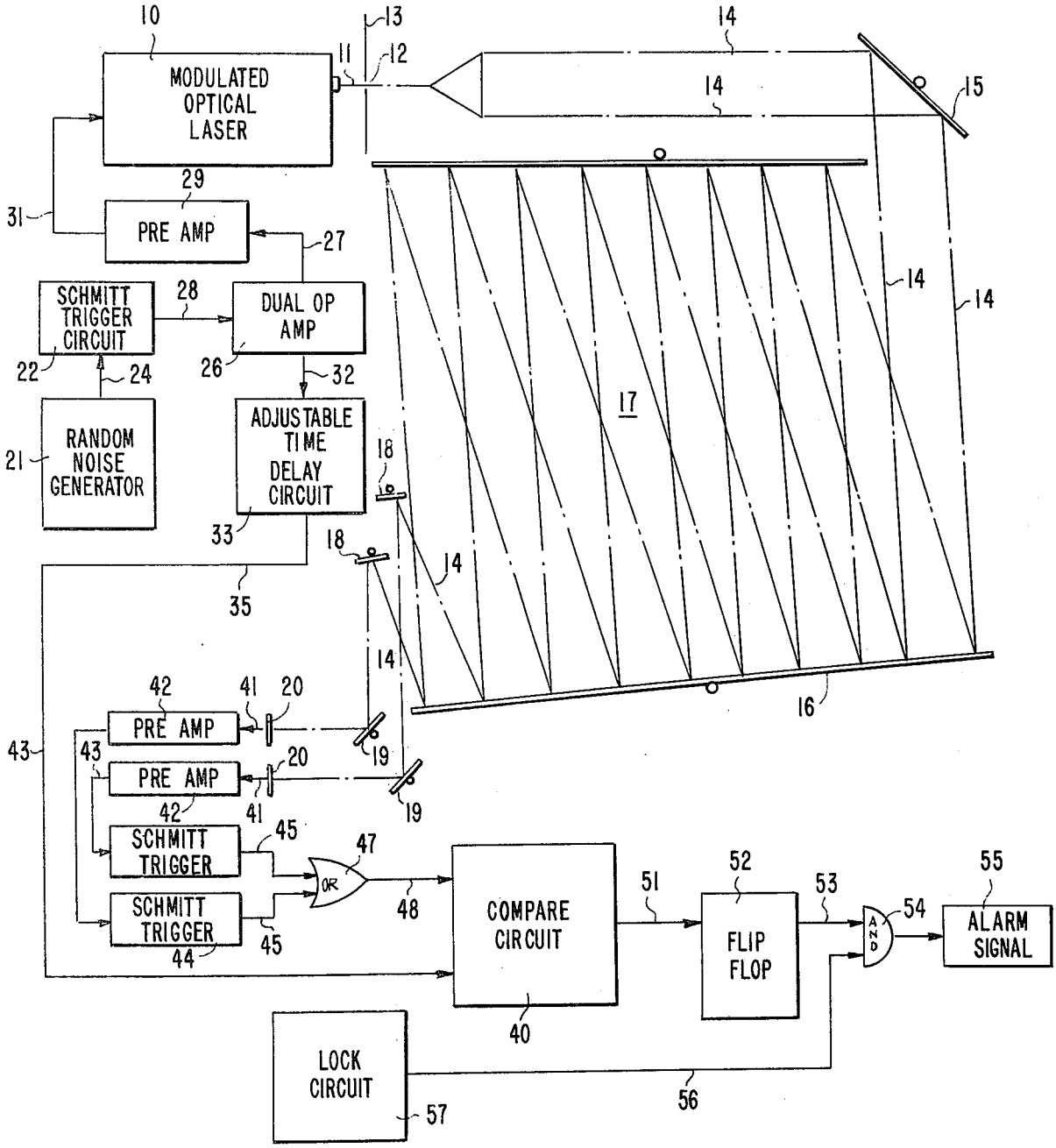
MODULATED OPTICAL LASER
PRE AMP
SCHMITT TRIGGER CIRCUIT
DUAL OP AMP
RANDOM NOISE GENERATOR
ADJUSTABLE TIME DELAY CIRCUIT
PRE AMP
PRE AMP
SCHMITT TRIGGER
SCHMITT TRIGGER
OR
COMPARE CIRCUIT
FLIP FLOP
AND
ALARM SIGNAL
LOCK CIRCUIT

OPTICAL LASER SECURITY SYSTEM

SUMMARY OF THE INVENTION

My invention is an optical laser security system for giving an alarm when the protected area is entered by an intruder. The system comprises an optical laser, operating in a continuous mode and modulated by a random noise generator.

The laser beam is split into parallel beams which are reflected throughout the area by mirrors and each directed into a photo sensitive electronic receptor circuit which electronically combines the output signals of the parallel beams of laser light.

The combined output is electronically compared with the signal employed to modulate the laser beams, with an alarm circuit triggered when any difference is detected between the output signal generated by the laser beams and the input modulating signal.

Since the laser beams are coherent and do not diverge for any length, as does normal light, the system eliminates the need for focusing lenses or for critical optical alignment.

The system, aside from reflecting mirrors, may be self-contained in one unit and powered by both an external power supply and an emergency battery power supply.

Disabling of such a system, by employing a flashlight or other light source would be to no avail as the flashlight would upset the balance in the output comparison circuit.

Multiple beams prevent the system from being falsely triggered by dust, or insects.

BRIEF DESCRIPTION OF THE DRAWING

The objects and features of the invention may be understood with reference to the following detailed description of an illustrative embodiment of the invention, taken together with the accompanying drawing in which:

The FIGURE is a schematic diagram of the invention.

DESCRIPTION OF THE PREFERRED EMBODIMENT

Turning now descriptively to the drawings, the FIGURE illustrates the laser alarm system. A modulated optical laser 10 emits a beam 11 of coherent light which is passed through a 1 micron pinhole 12 in a screen and through an optical beam splitter 13 to produce two parallel laser beams 14. The parallel beams 14 are reflected by mirrors 15 and 16 in a pattern throughout the area 17 to be protected. Each beam 14 is reflected by individual mirrors 18 and 19 to an individual photocell 20 or other photo-electric receptor.

The laser 10 is modulated continuously by a random noise audio generator 21 the output pulses 24 of which are shaped into digital pulses by a Schmitt Trigger Circuit 22 to which they are fed. The output 25 from the Schmitt Trigger Circuit 22 is fed to a dual operational amplifier 26, with one output 27 from amplifier 26 fed to a pre-amplifier circuit 29 which modulates the laser 10 through output 31, and with the other output 32 of the amplifier 26 fed to an adjustable time delay circuit 33. The time delay circuit output 35 is then led to the compare circuit 40.

The electronic output 41 of each photo receptor 20 is led to an individual pre-amplifier circuit 42, with each pre-amplifier output 43 led to an individual Schmitt Trigger Circuit 44 to form into a digital pulse. The outputs 45 of each Schmitt Trigger Circuit 44 are combined by OR circuit 47 and fed by the OR output 48 to the Compare Circuit 40.

The Compare Circuit 40 compares the reassembled signal received from the laser beam output photoreceptors 20 with the emitted laser beam signal 11 as modulated and if the compared signals differ or if one signal is momentarily absent, the output 51 of the Compare Circuit 40 triggers off a connected Flip-Flop Circuit 52 which is connected by lead 53, through an AND gate 54 to an alarm circuit 55. The AND gate 54 is also fed by input lead 56 from a crypto-lock circuit 57 which is employed to set the alarm apparatus when it is desired to have the security system in operation.

The system may employ a 100% modulated laser of 1 milliwatt output as sold by Edmund Scientific Company under part number 79,028 or 79,029.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by letters patent of the United States is:

1. A security system for giving an alarm when an intruder in a protected area interrupts a laser beam of light, said system comprising a modulated laser which emits a continuous modulated beam of coherent light, a signal generator which modulates the said laser, a photo-electric light detector which transforms the light emitted by the laser to electronic signals, a dual operational amplifier which transmits the output of the signal generator both to the laser and to a Compare circuit, said Compare circuit also connected to the output of the photo-electric light detector circuit so as to compare the signal received by the said light detector circuit from the laser beam, with the laser modulation signal produced by the signal generator, and alarm triggering means connected to the Compare circuit, which means are energized when the Compare circuit distinguishes a difference between the signal produced by the signal generator and the signal received through the photo-electric light detector, in which the signal generator is a random noise generator connected to a Schmitt Trigger circuit, which Schmitt Trigger circuit converts the output of said random noise generator into digital pulses.

2. The combination as recited in claim 1 in which the laser beam is split into two or more parallel beams, with each beam focused on an individual photo-electric light detector and with an OR circuit that adds the output of the circuits of the individual light detectors so that a momentary interruption of one of the multiple parallel laser beams will not produce an alarm effect.

* * * * *